US011548704B1

(12) United States Patent
Chen

(10) Patent No.: US 11,548,704 B1
(45) Date of Patent: Jan. 10, 2023

(54) COMBINED DEVICE OF A BOX

(71) Applicant: Yen-Cheng Chen, New Taipei (TW)

(72) Inventor: Yen-Cheng Chen, New Taipei (TW)

( * ) Notice: Subject to any disclaimer, the term of this patent is extended or adjusted under 35 U.S.C. 154(b) by 0 days.

(21) Appl. No.: 17/469,975

(22) Filed: Sep. 9, 2021

(51) Int. Cl.
*B65D 55/12* (2006.01)
*B65D 43/12* (2006.01)

(52) U.S. Cl.
CPC ..... *B65D 55/12* (2013.01); *B65D 43/12* (2013.01)

(58) Field of Classification Search
CPC ..... B65D 55/12; B65D 43/12
USPC ..... 220/324
See application file for complete search history.

(56) References Cited

U.S. PATENT DOCUMENTS 6,666,348 B2 * 12/2003 Fore ..... B65D 45/20 220/676
11,117,714 B2 * 9/2021 Green ..... B65D 21/0223
2005/0161455 A1 * 7/2005 Studee ..... B65D 43/0281 220/4.24
2006/0021889 A1 * 2/2006 Kim ..... A45C 11/00 206/320
2009/0223966 A1 * 9/2009 Kidd ..... B65D 75/22 220/324
2012/0103990 A1 * 5/2012 McCumber ..... B65D 41/165 220/270
2012/0234850 A1 * 9/2012 Picard ..... B65D 43/162 220/837
2012/0312812 A1 * 12/2012 Sosnovsky ..... B65D 45/22 220/23.83
2015/0014320 A1 * 1/2015 Koo ..... B65D 43/0214 220/345.6
2015/0069064 A1 * 3/2015 Johnson ..... B65D 43/162 220/324
2016/0251124 A1 * 9/2016 Arnold ..... B65D 43/265 220/324
2018/0079568 A1 * 3/2018 Shmeltzer ..... B65D 43/162
2021/0205817 A1 * 7/2021 Bonnoitt, Jr. ..... B65D 43/162

* cited by examiner

*Primary Examiner* — J. Gregory Pickett
*Assistant Examiner* — Niki M Eloshway

(57) ABSTRACT

A combined device of a box is composed of soft and elastic materials, and includes: a lid; a shell body, the lid covers the shell body to form the box; at least one fastening portion; The fastening portion is accommodated in an accommodating cavity of the buckle slot, and the width as clamping for the buckle slot to hook and contact is less than or equal to the width for the fastening portion to hook and contact, so as to fix the lid and the shell.

7 Claims, 11 Drawing Sheets

COMBINED DEVICE OF A BOX

BACKGROUND OF THE INVENTION

Field of the Invention

A combination device, especially a combined device of a box.

The Prior Arts

The box in the prior art, the opening edge of the lid and the shell body are not easy to adhere closely, which easily causes the food contained in the box to overflow and detach. In addition, the box in the prior art is adopted locking members that are not easy to hook and buckle each other, and are easy to loosen in structure, which makes it difficult for the lid and the shell body of the box to be held and fitted together.

SUMMARY OF THE INVENTION

The purpose of this invention is to provide a combined device of a box that overcomes the shortcomings in the prior art. The present invention technical means for a combined structure of a box is a combined device of a box, includes: a lid; a shell body, the lid covered the shell body to form the box; at least one fastening portion, the position where the fastening portion is connected is selected from at least one of the opening edges of the lid and the shell body, the fastening portion has a plurality of contact surfaces, two contact positions which are located on connection between every two contact surfaces, two contact positions are hooked on the outside of the fastening portion, two contact positions are used to form a longest width for the fastening portion to hook and contact; and at least one buckle slot, the position where the buckle slot is connected is selected from at least one of the opening edges of the lid and the shell body, an opening portion of the buckle slot is formed by two connected opening planes, between the two opening planes is connected another two contact positions hooked by the buckle slot, another two contact positions are used to form a width for the buckle slot to hook and contact, wherein the fastening portion is hooked and accommodated in an accommodating cavity of the buckle slot, and the width as clamping for the buckle slot to hook and contact is less than or equal to the width for the fastening portion to hook and contact, so as to fix the lid and the shell body.

In an embodiment of the present invention, a combining device of a box is provided, wherein the fastening portion has a first contact surface on an upper surface of the fastening portion, and a fourth contact surface connected to the first contact surface, one end of the fourth contact surface is adjacent to the opening position of the box, and the position of the first contact surface connected to the fourth contact surface is formed a third contact position and a fourth contact position for hook and contact, another end of the first contact surface is formed a first contact position and a second contact position for hook and contact, and the other end of the fourth contact surface is formed a sixth contact position and a seventh contact position for hook and contact, wherein a second contact surface is respectively connected one side of the first contact surface and one side of the fourth contact surface, a third contact surface is respectively connected another side of the first contact surface and another side of the fourth contact surface, a fifth contact position and the third contact position are diagonal to each other on the third contact surface, an eighth contact position and the fourth contact position are diagonal to each other on the second contact surface, wherein a distance between the third contact position and the fourth contact position is longer than or equal to a distance between the first contact position and the second contact position, and the distance between the third contact position and the fourth contact position is longer than or equal to a distance between the sixth contact position and the seventh contact position, the distance between the first contact position and the second contact position is longer than or equal to the distance between the fifth contact position and the eighth contact position, the distance between the sixth contact position and the seventh contact position is longer than or equal to the distance between the fifth contact position and the eighth contact position, and the distance between the third contact position and the fourth contact position is longer than or equal to the fifth contact position and the eighth contact position.

In an embodiment of the present invention, a combined device of a box is provided, wherein connected between the two opening planes of the buckle slot are a ninth contact position and a tenth contact position that are hooked and contacted by the buckle slot, two opening planes of the buckle slot are formed to be a notch, two opening planes of the buckle slot can be enlarged and then elastically retracted again to form a notch, as to result double-mouth clamping elastic force, the fastening portion is hooked by a notch of double-mouth clamping elastic force in the sliding state, the two opening planes of the buckle slot are enlarged in the sliding state, wherein another end of an opening plane is an eleventh contact position and a twelfth contact position, another end of another opening plane is a thirteenth contact position and a fourteenth contact position, wherein two opposite corners of the ninth contact position and the tenth contact position in the accommodating cavity are a fifteenth contact position and a sixteenth contact position. From the tenth contact position to the sixteenth contact position are located on the outside surface of the inner side of the accommodating cavity.

In an embodiment of the present invention, a combined device of a box is provided, wherein a distance between the thirteenth contact position and the fourteenth contact position is less than or equal to the distance between the sixth contact position and the seventh contact position, the distance between the ninth contact position and the tenth contact position is less than or equal to the distance between the fifth contact position and the eighth contact position, as to form a contact extension from the fourteenth contact position to the tenth contact position which extends toward inner to hook and contact the third contact surface and form the contact extension from the thirteenth contact position to the ninth contact position which extends toward inner to hook and contact the second contact surface.

In an embodiment of the present invention, a combined device of a box is provided, the fastening portion is hooked by a notch of double-mouth clamping elastic force in the sliding state, the two opening planes of the buckle slot are enlarged in the sliding state, wherein a distance between the tenth contact position and the ninth contact position is less than or equal to the distance between the fifth contact position and the eighth contact position, the distance between the eleventh contact position and the twelfth contact position is less than or equal to the distance between the 1st contact position and the second contact position, as to form a contact extension from the eleventh contact position to the tenth contact position which extends toward inner to hook and contact the third contact surface and form the contact extension from the thirteenth contact position to the ninth contact position which extends toward inner to hook and contact the second contact surface.

In an embodiment of the present invention, a combined device of a box is provided, wherein the fastening portion has a convex body on the first contact surface, the buckle slot has a positioning slot, the positioning slot is located at a corresponding hooked position to the convex body, the convex body is hooked and combined with the positioning slot to form the buckle slot and the fastening portion to be held, wherein the fastening portion is located on a clasp piece, and a position of the clasp piece is connected by a bending portion, the position of the clasp piece is selected from at least one of the opening edges of the lid and the shell body.

In an embodiment of the present invention, a combined device of a box is provided, wherein the fastening portion has a convex body located on the fourth contact surface, the buckle slot has a positioning slot, the positioning slot is located at a corresponding hooked position to the convex body, and the convex body is hooked and combined with the positioning slot to form the buckle slot and the fastening portion to be held, wherein the position of the buckle slot is selected from at least one of the opening edges of the lid and the shell body, wherein the buckle slot is further recess toward inside recessed position of the opening edge, and the position where the buckle slot is connected is selected from at least one of the opening edges of the lid and the shell body.

In an embodiment of the present invention, a combined device of a box is provided, wherein the soft and elastic material is composed of at least one material selected from paper plastic, plastic, and environmental protection resin.

In an embodiment of the present invention, a combined device of a box is provided, wherein the opening slot surface structure of the buckle slot, the ninth contact position and the tenth contact position where an opening for hooking are selected at least one of a convex rectangle shape, a triangle shape, an arc shape, and a trapezoid shape, wherein the inner side of the accommodating cavity, the eleventh contact position, the twelfth contact position, the thirteenth contact position, the fourteenth contact position, the fifteenth contact position, and the sixteenth contact position are at least one of triangular shape, arc shape and trapezoid shape, wherein the connection structure between the first contact surface, the second contact surface, the third contact surface, and the fourth contact surface is selected from at least one of a triangular shape and an arc shape.

In an embodiment of the present invention, a combined device of a box is provided, wherein the opening slot surface structure of the buckle slot, the ninth contact position and the tenth contact position where an opening for hooking are selected at least one of a convex rectangle shape, a triangle shape, an arc shape, and a trapezoid shape, wherein the inner side of the accommodating cavity, the eleventh contact position, the twelfth contact position, the thirteenth contact position, the fourteenth contact position, the fifteenth contact position, and the sixteenth contact position are at least one of triangular shape, arc shape and trapezoid shape, wherein the connection structure between the first contact surface, the second contact surface, the third contact surface, and the fourth contact surface is selected from at least one of a triangular shape and an arc shape.

The technical means of this invention are provided four types of structures for hook and contact, wherein the two opening planes of the buckle slot can be elastically enlarged and then elastically retracted again to form a notch of the buckle slot, as to result double-mouth clamping elastic force, includes: The first structure is the convex body of the fastening portion is hooked by the positioning slot of the buckle slot. The second structure is the contact extension surface formed from the tenth contact position to the fourteenth contact position, which hook and contact toward inside the third contact surface, and the second structure is the contact extension surface formed from the ninth contact position to the thirteenth contact position, which hook and contact toward inside the second contact surface. The third structure the contact extension surface formed from the tenth contact position to the eleventh contact position, which hook and contact toward inside the third contact surface, and the second structure is the contact extension surface formed from the ninth contact position to the twelfth contact position, which hook and contact toward inside the second contact surface. The fourth structure is that when the buckle slot hooks the fastening portion in a sliding state, wherein the two opening planes of the buckle slot can be elastically in enlarged state to form a notch of the buckle slot, includes: the distance between the ninth contact position 201 and the tenth contact position 202 of the buckle slot is longer than or equal to the distance between the third contact position 103 and the fourth contact position 104 of the fastening portion, the distance between the ninth contact position 201 and the tenth contact position 202 of the buckle slot is longer than or equal to the distance between the first contact position 101 and the second contact position 102 of the fastening portion. the distance between the ninth contact position 201 and the tenth contact position 202 of the buckle slot is longer than or equal to the sixth contact position 106 and the seventh contact position 107 of the fastening portion, and the distance between the ninth contact position 201 and the tenth contact position 202 of the buckle slot is longer than or equal to the fifth contact position 105 and the eighth contact position of the fastening portion. Wherein the two opening planes of the buckle slot can be elastically in enlarged state to form a notch of the buckle slot, then elastically retracted again to form a notch of the buckle slot, as to result double-mouth clamping elastic force. The two opening planes of the buckle slot can be elastically retracted again to form a notch of the buckle slot, wherein elastically retracted state, includes: the distance between the ninth contact position 201 and the tenth contact position 202 of the buckle slot is less than or equal to the distance between the third contact position 103 and the fourth contact position 104 of the fastening portion, the distance between the ninth contact position 201 and the tenth contact position 202 of the buckle slot is less than or equal to the distance between the first contact position 101 and the second contact position 102 of the fastening portion. the distance between the ninth contact position 201 and the tenth contact position 202 of the buckle slot is less than or equal to the sixth contact position 106 and the seventh contact position 107 of the fastening portion, and the distance between the ninth contact position 201 and the tenth contact position 202 of the buckle slot is less than or equal to the fifth contact position 105 and the eighth contact position of the fastening portion. When the fastening portion is hooked by a notch of double-mouth clamping elastic force in the sliding state, the fourth structure is clamped by the following structure of the fastening portion, the fastening portion is a polyhedron with inclined surfaces, wherein includes: the distance between the third contact position 103 and the fourth contact position 104 is longer than or equal to the distance between the first contact position 101 and the second contact position 102. and the distance between the third contact position 103 and the fourth contact position 104 is longer than or equal to the sixth contact position 106 and the seventh contact position 7. The distance between the first contact position 101 and the distance between the second contact position 102 is longer than or equal to the distance between the fifth contact position 105 and the eighth contact position 108. The distance between the sixth contact position 106 and the seventh contact position 107 is longer than or equal to the distance between the fifth contact position 105 and the eighth contact position 108. The distance therebetween the third contact position 103 and the fourth contact position 104 is longer than or equal to the distance between the fifth contact position 105 and the eighth contact position 108. Therefore, the technical means of this invention are composed of soft and elastic materials. During the hooking and fastening process, the soft and elastic material can be expanded and then elastically retracted. And the two opening planes of the buckle slot can be enlarged and then elastically retracted again to form a notch, as to result double-mouth clamping elastic force. The above-mentioned first structure to the fourth structure overcomes the prior art is that the buckle slot and the fastening portion in the box are not easy to hooked and fastened each other, and the disadvantages are that they are easy to loosen in structure.

DETAILED DESCRIPTION OF THE PREFERRED EMBODIMENT

Figure 1:
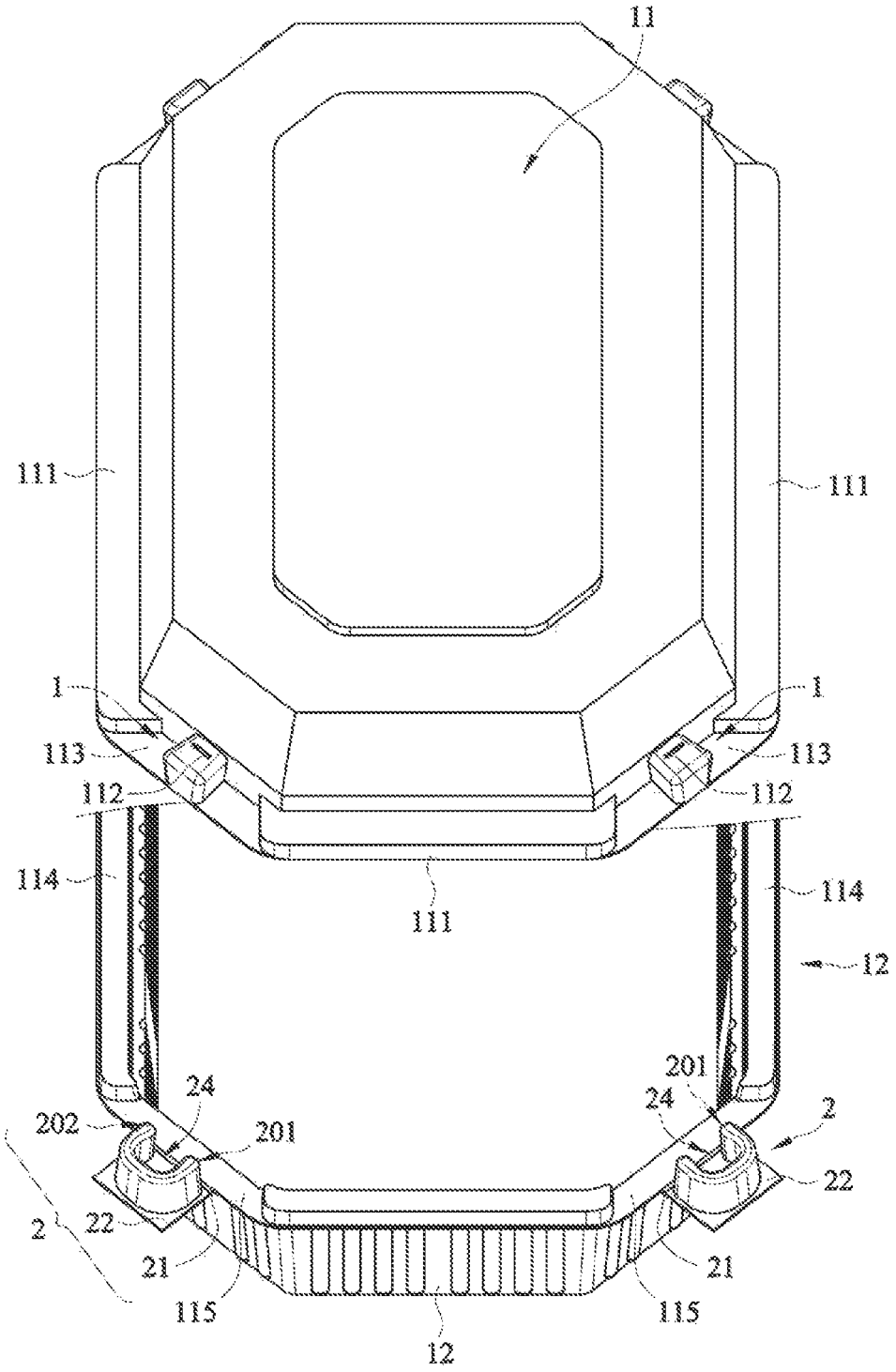
FIG. 1 is a top view schematic diagram of the present invention.
Figure 2:
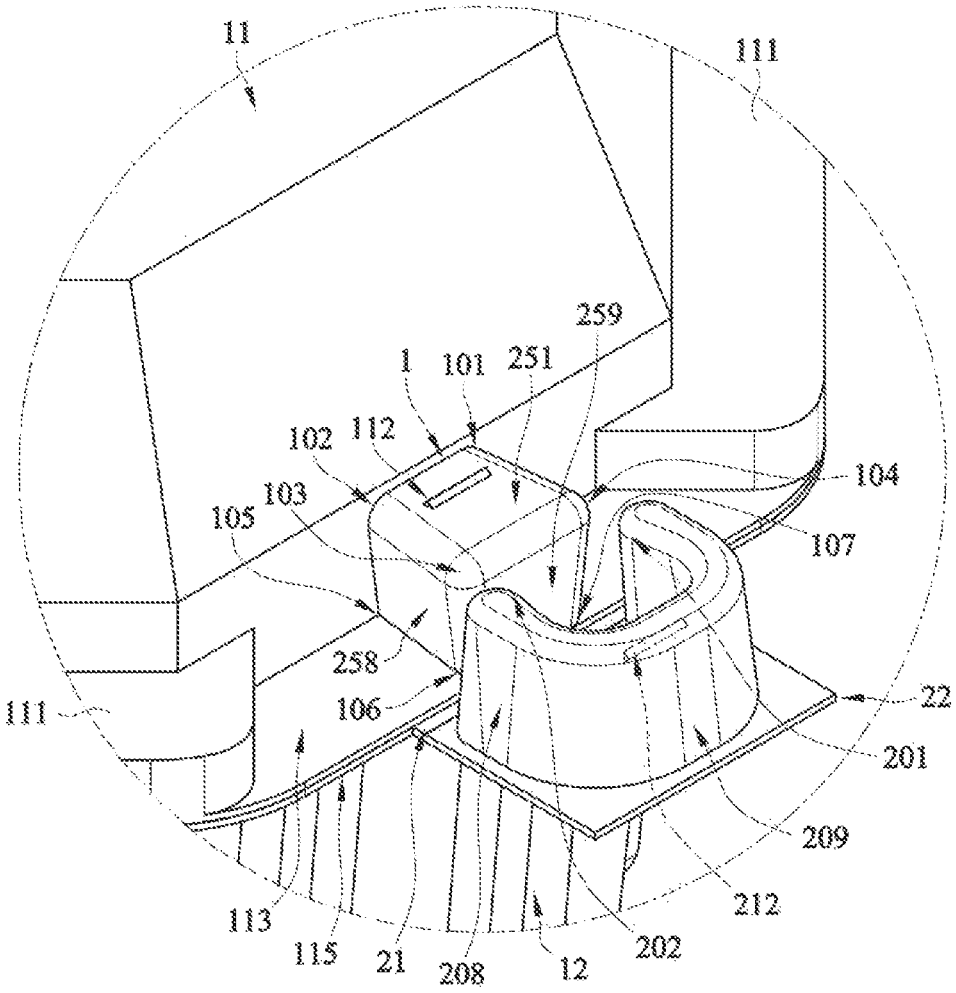
FIG. 2 is a three-dimensional side view schematic diagram of the buckle slot and the fastening portion of the present invention.
Figure 3:
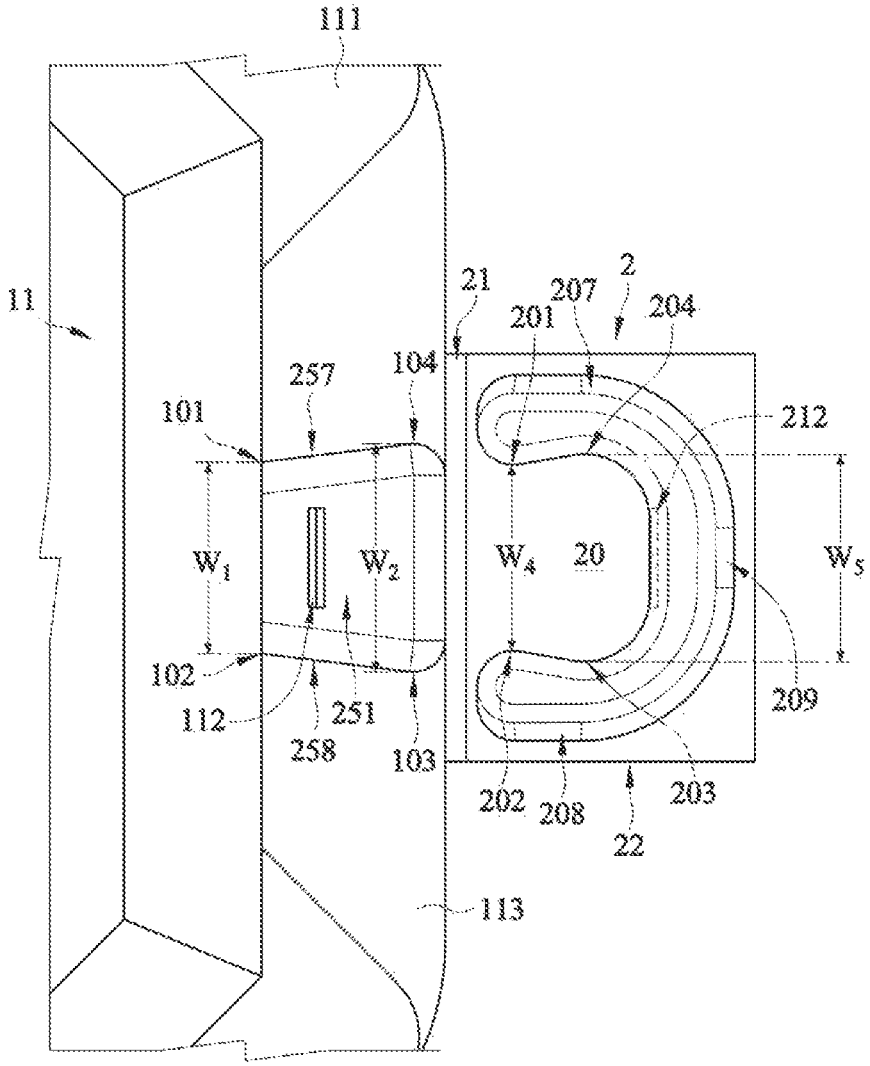
FIG. 3 is a bottom view schematic diagram of the buckle slot and the fastening portion of the present invention.
Figure 4:
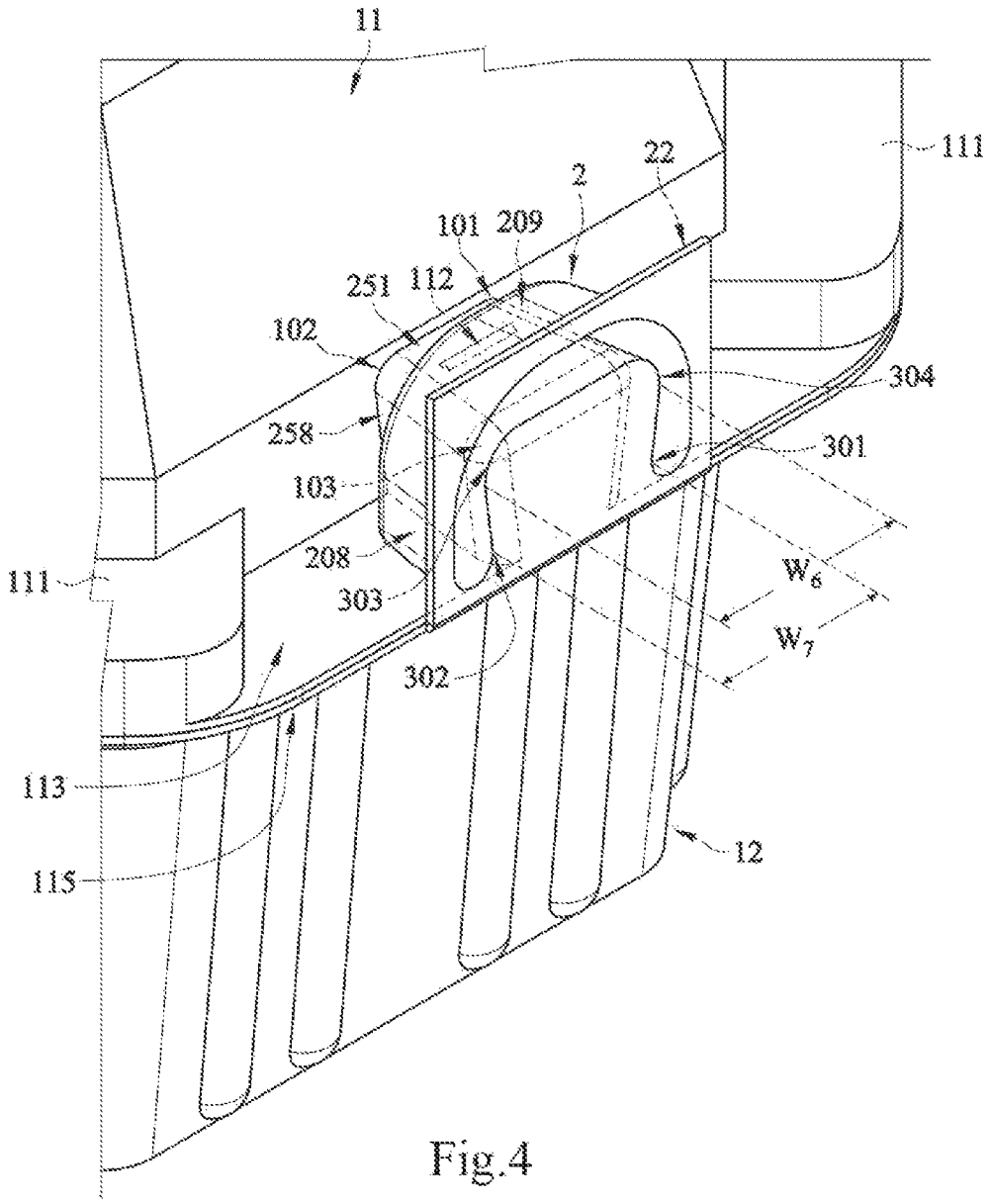
FIG. 4 is a schematic diagram of the combination of the creative buckle slot and the fastening portion of the present invention.
Figure 5:
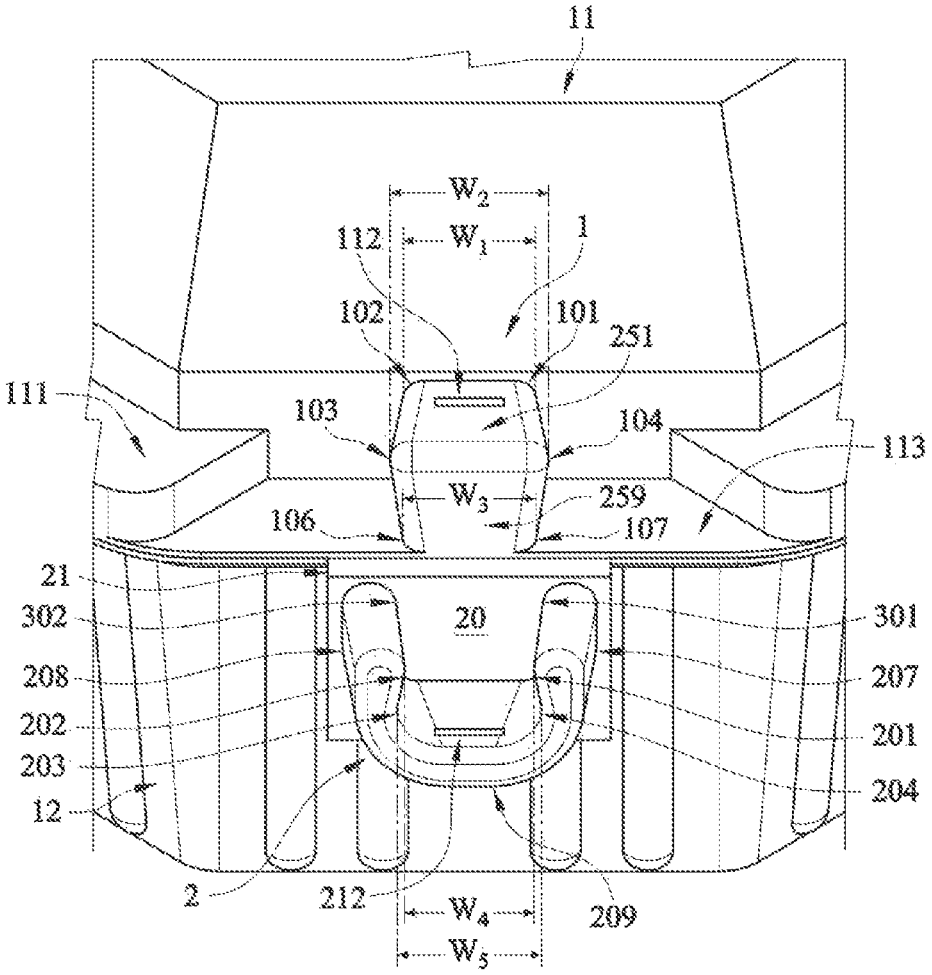
FIG. 5 is a schematic diagram of the front view of the buckle slot and the fastening portion of the present invention.

As shown in FIGS. 1 to 5, a combined device of the box according to an embodiment of the present invention, wherein the box combining device is composed of soft and elastic materials, includes: a lid, a shell body, at least one fastening portion 1, and at least one buckle slot 2. Wherein the lid covered the shell body to form the box; at least one fastening portion 1, the position where the fastening portion 1 is connected is selected from at least one of the opening edges of the lid and the shell body, the fastening portion 1 has a plurality of contact surfaces, two contact positions which are located on connection between every two contact surfaces, two contact positions are hooked on the outside of the fastening portion 1, two contact positions are used to form a longest width for the fastening portion 1 to hook and contact; and at least one buckle slot 2, the position where the buckle slot 2 is connected is selected from at least one of the opening edges of the lid and the shell body, an opening portion of the buckle slot 2 is formed by two connected opening planes, between the two opening planes is connected another two contact positions hooked by the buckle slot 2, another two contact positions are used to form a width for the buckle slot 2 to hook and contact, wherein the fastening portion 1 is hooked and accommodated in an accommodating cavity 20 of the buckle slot 2, and the width as clamping for the buckle slot 2 to hook and contact is less than or equal to the width for the fastening portion 1 to hook and contact, so as to fix the lid and the shell body. Wherein the opening edges of the lid 11 and the shell body may be an edge portion 111, an edge portion 114, or an extension portion (113, 115).

As shown in FIGS. 8A to 8F, a combined device of the box according to an embodiment of the present invention, wherein the fastening portion 1 has a first contact surface 251 on an upper surface of the fastening portion 1, and a fourth contact surface 259 connected to the first contact surface 251, one end of the fourth contact surface 259 is adjacent to the opening position of the box, and the position of the first contact surface 251 connected to the fourth contact surface 259 is formed a third contact position 103 and a fourth contact position 104 for hook and contact, another end of the first contact surface 251 is formed a first contact position 101 and a second contact position 102 for hook and contact, and the other end of the fourth contact surface 259 is formed a sixth contact position 106 and a seventh contact position 107 for hook and contact, wherein a second contact surface 257 is respectively connected one side of the first contact surface 251 and one side of the fourth contact surface 259, a third contact surface 258 is respectively connected another side of the first contact surface 251 and another side of the fourth contact surface 259, a fifth contact position 105 and the third contact position 103 are diagonal to each other on the third contact surface 258, an eighth contact position 108 and the fourth contact position 104 are diagonal to each other on the second contact surface 257, wherein a distance between the third contact position 103 and the fourth contact position 104 is longer than or equal to a distance between the first contact position 101 and the second contact position 102, and the distance between the third contact position 103 and the fourth contact position 104 is longer than or equal to a distance between the sixth contact position 106 and the seventh contact position 107, the distance between the first contact position 101 and the second contact position 102 is longer than or equal to the distance between the fifth contact position 105 and the eighth contact position 108, the distance between the sixth contact position 106 and the seventh contact position 107 is longer than or equal to the distance between the fifth contact position 105 and the eighth contact position 108, and the distance between the third contact position 103 and the fourth contact position 104 is longer than or equal to the fifth contact position 105 and the eighth contact position 108.

As shown in FIGS. 1 to 5, 8A to 8F, and 7A to 7D, the fourth structure is that when the buckle slot 2 hooks the fastening portion 1 in a sliding state, wherein connected between the two opening planes of the buckle slot 2 are a ninth contact position 201 and a tenth contact position 202 that are hooked and contacted by the buckle slot 2, two opening planes of the buckle slot 2 are formed to be a notch 24, the two opening planes of the buckle slot 2 can be enlarged and then elastically retracted again to form a notch 24, as to result double-mouth clamping elastic force, wherein another end of an opening plane is an eleventh contact position 203 and a twelfth contact position 204, another end of another opening plane is a thirteenth contact position 301 and a fourteenth contact position 302, wherein two opposite corners of the ninth contact position 201 and the tenth contact position 202 in the accommodating cavity 20 are a fifteenth contact position 303 and a sixteenth contact position 304. Because the fourth structure is clamped by the above-mentioned structure when the buckle slot 2 hooks the fastening portion 1 in a sliding state, therefore, the technical means of this invention can be easily hooked with each other, and the structure of the specific effect and purpose is not easy to loosen.

As shown in FIGS. 1 to 5, and FIGS. 7A to 7D, a combined device of a box according to an embodiment of the present invention, wherein connected between the two opening planes of the buckle slot 2 are a ninth contact position 201 and a tenth contact position 202 that are hooked and contacted by the buckle slot 2, two opening planes of the buckle slot 2 are formed to be a notch 24, two opening planes of the buckle slot 2 are enlarged and then elastically retracted again to form a notch 24, as to result double-mouth clamping elastic force, wherein another end of an opening plane is an eleventh contact position 203 and a twelfth contact position 204, another end of another opening plane is a thirteenth contact position 301 and a fourteenth contact position 302, wherein two opposite corners of the ninth contact position 201 and the tenth contact position 202 in the accommodating cavity 20 are a fifteenth contact position 303 and a sixteenth contact position 304.

Figure 8A:
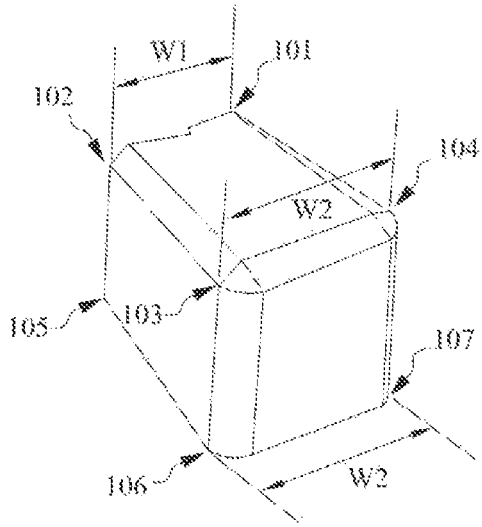
FIG. 8A is a schematic diagram of a buckle slot according to an embodiment of the present invention.
Figure 8B:
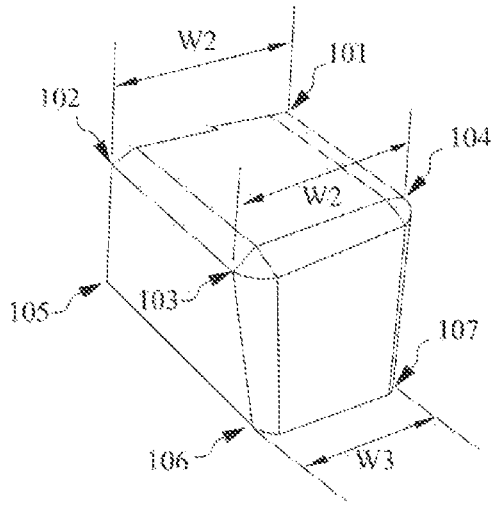
FIG. 8B is a schematic diagram of a buckle slot according to an embodiment of the present invention.
Figure 8C:
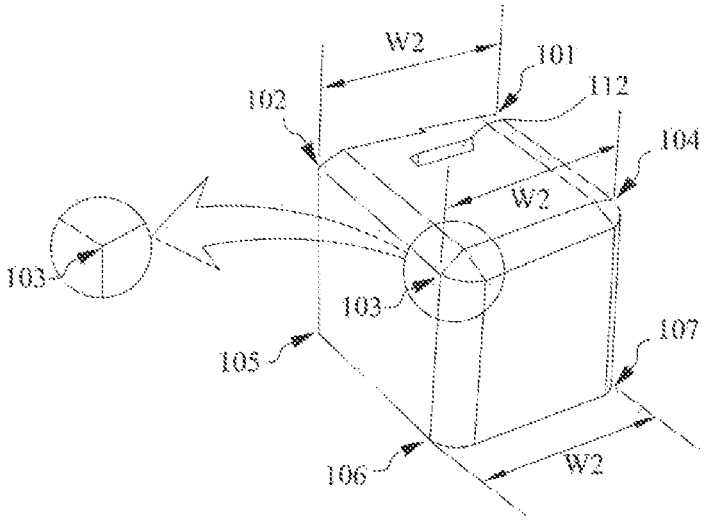
FIG. 8C is a schematic diagram of a buckle slot according to an embodiment of the present invention.
Figure 8D:
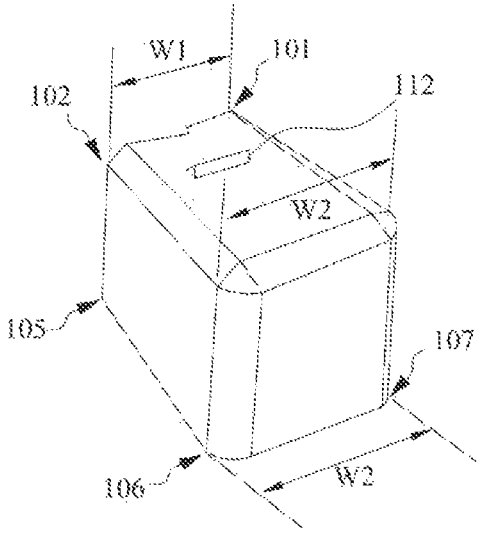
FIG. 8D is a schematic diagram of a buckle slot according to an embodiment of the present invention.
Figure 8E:
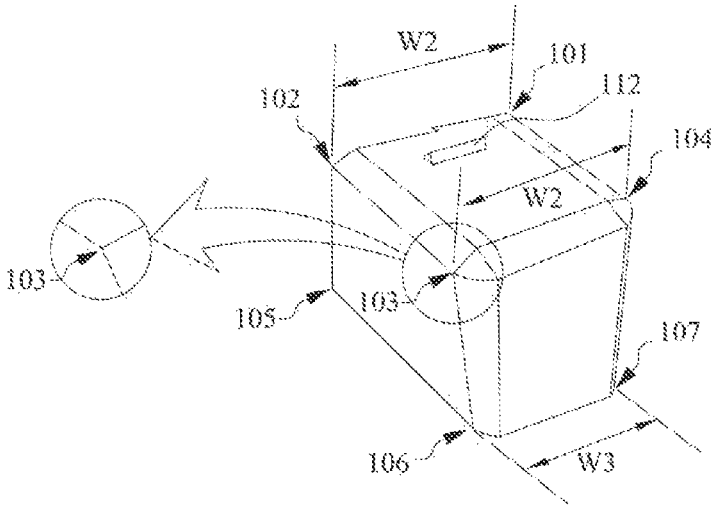
FIG. 8E is a schematic diagram of a buckle slot according to an embodiment of the present invention.
Figure 8F:
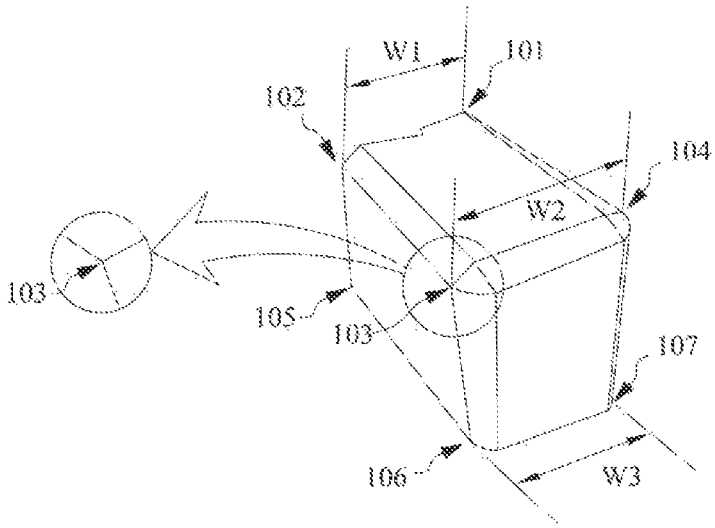
FIG. 8F is a schematic diagram of a buckle slot according to an embodiment of the present invention.

As shown in FIGS. 1 to 8F, a combining device of the box according to an embodiment of the present invention, the second structure wherein a distance between the thirteenth contact position 301 and the fourteenth contact position 302 is less than or equal to the distance between the sixth contact position 106 and the seventh contact position 107, the distance between the ninth contact position 201 and the tenth contact position 202 is less than or equal to the distance between the fifth contact position 105 and the eighth contact position 108, as to form a contact extension from the fourteenth contact position 302 to the tenth contact position 202 which extends toward inner to hook and contact the third contact surface 258 and form the contact extension from the thirteenth contact position 301 to the ninth contact position 201 which extends toward inner to hook and contact the second contact surface 257. As shown in FIGS. 1 to 8F, the first width W1, the second width W2, the third width W3, the fourth width W4, the fifth width W5, the sixth width W6, the seventh width W7, and the eighth width W8 are the distance between the corresponding contact position. As shown in FIG. 8A, the first width W1 is less than the second width W2. As shown in FIG. 8B, the third width W3 is less than the second width W2. As shown in FIG. 8C, the first width W1 is less than the second width W2. As shown in FIG. 8E, the third width W3 is less than the second width W2. As shown in FIG. 8F, the third width W3 is less than the second width W2, and the first width W1 is less than the second width W2.

As shown in FIGS. 1 to 8F, a combined device of the box according to an embodiment of the present invention, the third structure wherein a distance between the tenth contact position 202 and the ninth contact position 201 is less than or equal to the distance between the fifth contact position 105 and the eighth contact position 108, the distance between the eleventh contact position 203 and the twelfth contact position 204 is less than or equal to the distance between the 1st contact position and the second contact position 102, as to form a contact extension from the eleventh contact position 203 to the tenth contact position 202 which extends toward inner to hook and contact the third contact surface 258 and form the contact extension from the thirteenth contact position 301 to the ninth contact position 201 which extends toward inner to hook and contact the second contact surface 257. The fifth contact surface 207, the sixth contact surface 208, and the seventh contact surface 209 are stretched and clamped the fastening portion 1 through elastic stretching.

As shown in FIGS. 1 to 8F, a combination device of the box according to an embodiment of the present invention, wherein the fastening portion 1 has a convex body on the first contact surface 251, the buckle slot 2 has a positioning slot 212, the positioning slot 212 is located at a corresponding hooked position to the convex body, the convex body is hooked and combined with the positioning slot 212 to form the buckle slot 2 and the fastening portion 1 to be held, wherein the fastening portion 1 is located on a clasp piece 22, and a position of the clasp piece 22 is connected by a bending portion 21, the position of the clasp piece 22 is selected from at least one of the opening edges of the lid and the shell body.

Figure 6A:
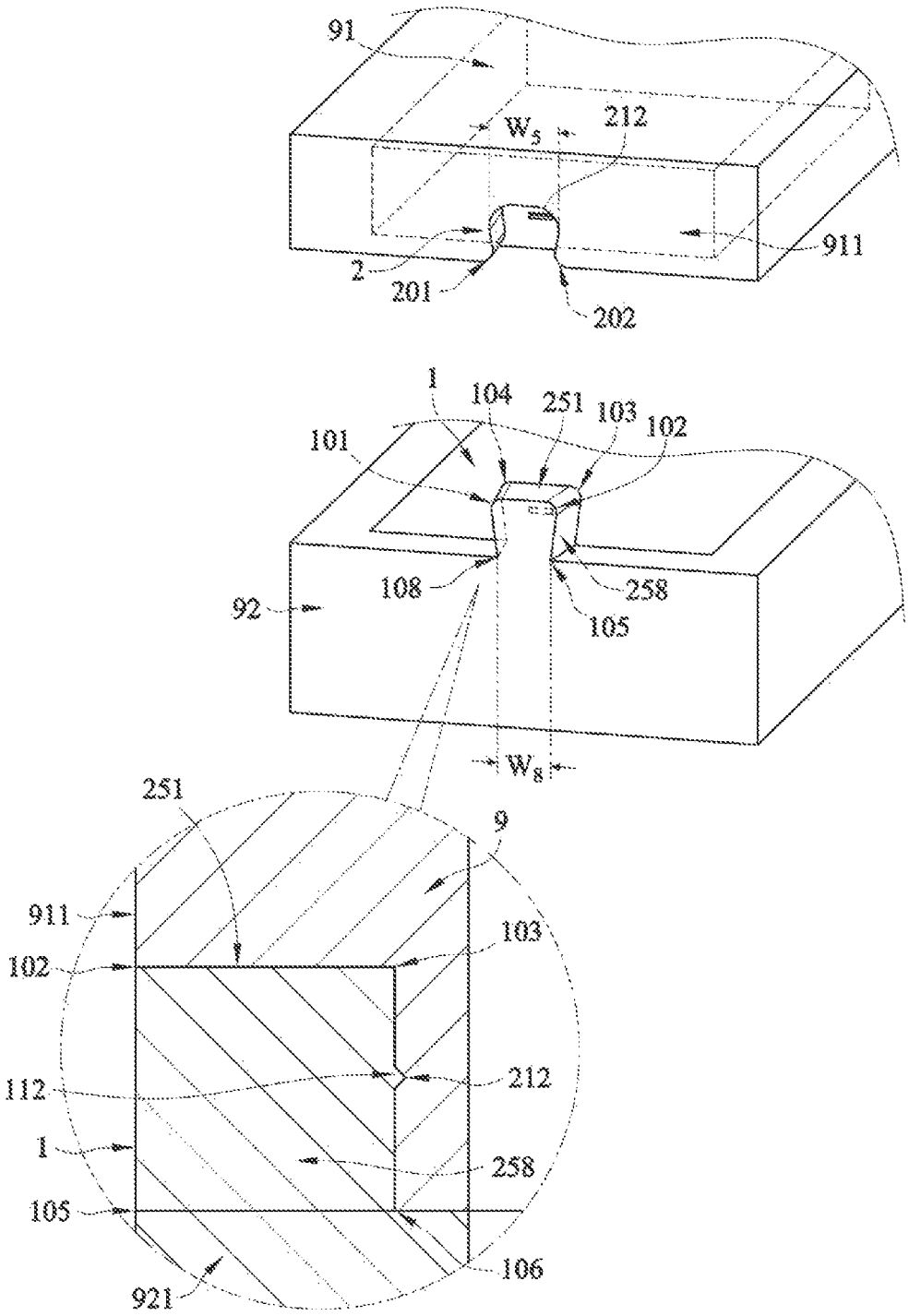
FIG. 6A is a schematic diagram of the front view of the buckle slot and the fastening portion according to an embodiment of the present invention.
Figure 7A:
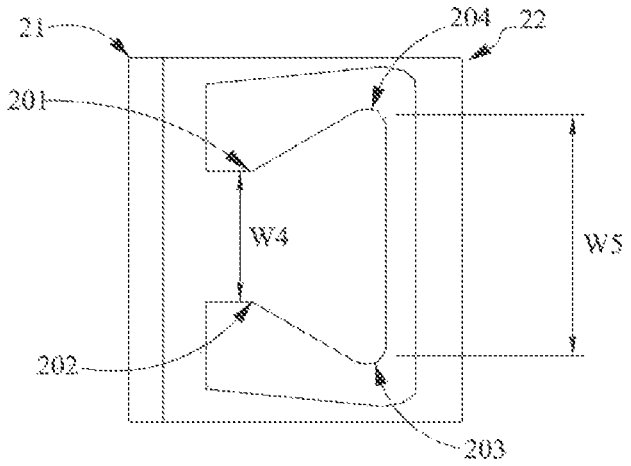
FIG. 7A is a schematic diagram of the fastening portion according to an embodiment of the present invention.
Figure 7B:
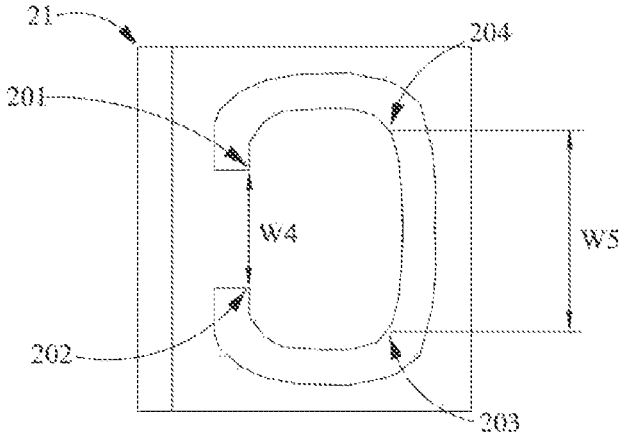
FIG. 7B is a schematic diagram of the fastening portion according to an embodiment of the present invention.
Figure 7C:
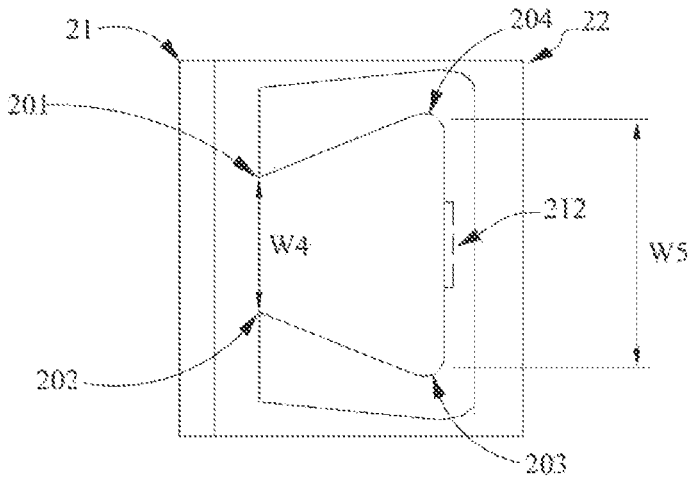
FIG. 7C is a schematic diagram of the fastening portion according to an embodiment of the present invention.
Figure 7D:
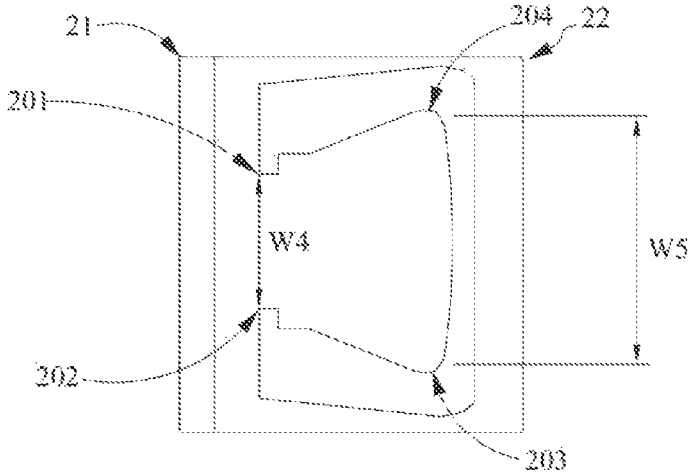
FIG. 7D is a schematic diagram of the fastening portion according to an embodiment of the present invention.

As shown in FIG. 6A, a combination device of the box according to an embodiment of the present invention, wherein the fastening portion 1 has a convex body located on the fourth contact surface 259, the buckle slot 2 has a positioning slot 212, the positioning slot 212 is located at a corresponding hooked position to the convex body, and the convex body is hooked and combined with the positioning slot 212 to form the buckle slot 2 and the fastening portion 1 to be held, wherein the position of the buckle slot 2 is selected from at least one of the opening edges of the lid 91 and the shell body 92, Wherein, the opening edge of the lid 91 or the shell body 92 may be an edge portion 911. The buckle slot 2 is recessed inwardly at the concave position of the edge portion 911, wherein the buckle slot 2 is further recess toward inside recessed position of the opening edge, and the position where the buckle slot 2 is connected is selected from at least one of the opening edges of the lid 91 and the shell body 92.

A bonding device of the box according to an embodiment of the present invention, wherein the soft and elastic material is composed of at least one material selected from paper plastic, plastic, and environmental protection resin.

As shown in FIGS. 7A to 7D, according to an embodiment of t the present invention, two connected opening planes structure of the buckle slot 2 is selected at least one of which from C-shaped, V-shaped, U-shaped, and triangular-shaped, but not limited to foregoing. As long as the clamping width of the buckle slot 2 is less than or equal to the width of the fastening portion 1, the connecting structure formed is all in Equivalents range of this invention.

As shown in FIGS. 7A to 7D and FIGS. 8A to 8F, two connected opening planes structure of the buckle slot 2, wherein the opening slot surface structure of the buckle slot 2, the ninth contact position 201 and the tenth contact position 202 where an opening for hooking are selected at least one of a convex rectangle shape, a triangle shape, an arc shape, and a trapezoid shape, wherein the inner side of the accommodating cavity 20, the eleventh contact position 203, the twelfth contact position 204, the thirteenth contact position 301, the fourteenth contact position 302, the fifteenth contact position 303, and the sixteenth contact position 304 are at least one of triangular shape, arc shape and trapezoid shape, wherein the connection structure between the first contact surface 251, the second contact surface 257, the third contact surface 258, and the fourth contact surface 259 is selected from at least one of a triangular shape and an arc shape. but it is not limited to foregoing, As long as the clamping width of the buckle slot 2 is less than or equal to the width of the fastening portion 1, the connecting structure formed is all in Equivalents range of this invention.

The above descriptions and descriptions are only descriptions of the preferred embodiments of this invention. Those with general knowledge of this technology should make other modifications based on the scope of patent applications defined below and the above descriptions, but these Modifications should still be within the creative spirit of the present invention and within the scope of the rights of the present invention.

What is claimed is:

1. A combined device of a box, which is composed of soft and elastic materials, wherein includes:

a lid;

a shell body, the lid covered the shell body to form the box;

at least one fastening portion, the position where the fastening portion is connected is selected from at least one of the opening edges of the lid and the shell body, the fastening portion has a plurality of contact surfaces, two contact positions which are located on connection between every two contact surfaces, two contact positions are hooked on the outside of the fastening portion, two contact positions are used to form a longest width for the fastening portion to hook and contact; and at least one buckle slot, the position where the buckle slot is connected is selected from at least one of the opening edges of the lid and the shell body, an opening portion of the buckle slot is formed by two connected opening planes, between the two opening planes is connected another two contact positions hooked by the buckle slot, another two contact positions are used to form a width for the buckle slot to hook and contact, wherein the fastening portion is hooked and accommodated in an accommodating cavity of the buckle slot, and the width as clamping for the buckle slot to hook and contact is less than or equal to the width for the fastening portion to hook and contact, so as to fix the lid and the shell body;

Wherein the fastening portion has sloped contact surfaces on a polyhedron that are clamped by the buckle slot, a plurality of vertexes of the polyhedron are composed of contact positions, comprises: a first contact position, a second contact position, a third contact position, a fourth contact position, a fifth contact position, a sixth contact position, a seventh contact position, and a eighth contact position;

wherein a first contact surface is surrounded by connecting the first contact position, the second contact position, the third contact position, and the fourth contact position;

wherein a second contact surface is surrounded by connecting the first contact position, the fourth contact point, the seventh contact position, and the eighth contact position;

wherein a third contact surface is surrounded by connecting the second contact position, the third contact position, and the fifth contact point, the sixth contact position;

wherein a fourth contact surface is surrounded by connecting the fourth contact point, the sixth contact position, the seventh contact position, and the eighth contact position;

wherein the fastening portion has the first contact surface on an upper surface of the fastening portion, and a fourth contact surface connected to the first contact surface, one end of the fourth contact surface is adjacent to the opening position of the box, and the position of the first contact surface connected to the fourth contact surface is formed a third contact position and a fourth contact position for hook and contact, another end of the first contact surface is formed the first contact position and the second contact position for hook and contact, and the other end of the fourth contact surface is formed a sixth contact position and a seventh contact position for hook and contact, wherein the second contact surface is respectively connected one side of the first contact surface and one side of the fourth contact surface, the third contact surface is respectively connected another side of the first contact surface and another side of the fourth contact surface, a fifth contact position and the third contact position are diagonal to each other on the third contact surface, the eighth contact position and the fourth contact position are diagonal to each other on the second contact surface, wherein a distance between the third contact position and the fourth contact position is longer than or equal to a distance between the first contact position and the second contact position, and the distance between the third contact position and the fourth contact position is longer than or equal to a distance between the sixth contact position and the seventh contact position, the distance between the first contact position and the second contact position is longer than or equal to the distance between the fifth contact position and the eighth contact position, the distance between the sixth contact position and the seventh contact position is longer than or equal to the distance between the fifth contact position and the eighth contact position, and the distance between the third contact position and the fourth contact position is longer than or equal to the fifth contact position and the eighth contact position;

wherein connected between the two opening planes of the buckle slot are a ninth contact position and a tenth contact position that are hooked and contacted by the buckle slot, two opening planes of the buckle slot are formed to be a notch, two opening planes of the buckle slot are enlarged and then elastically retracted again to form a notch, as to result double-mouth clamping elastic force, wherein another end of an opening plane is an eleventh contact position and a twelfth contact position, another end of another opening plane is a thirteenth contact position and a fourteenth contact position, wherein two opposite corners of the ninth contact position and the tenth contact position in the accommodating cavity are a fifteenth contact position and a sixteenth contact position;

wherein a distance between the thirteenth contact position and the fourteenth contact position is less than or equal to the distance between the sixth contact position and the seventh contact position, the distance between the ninth contact position and the tenth contact position is less than or equal to the distance between the fifth contact position and the eighth contact position, as to form a contact extension from the fourteenth contact position to the tenth contact position which extends toward inner to hook and contact the third contact surface and form the contact extension from the thirteenth contact position to the ninth contact position which extends toward inner to hook and contact the second contact surface.

2. The box combination device as recited in claim 1, wherein a distance between the tenth contact position and the ninth contact position is less than or equal to the distance between the fifth contact position and the eighth contact position, the distance between the eleventh contact position and the twelfth contact position is less than or equal to the distance between the 1st contact position and the second contact position, as to form a contact extension from the eleventh contact position to the tenth contact position which extends toward inner to hook and contact the third contact surface and form the contact extension from the thirteenth contact position to the ninth contact position which extends toward inner to hook and contact the second contact surface.

3. The combined device of a box as claimed in claim 2, the fastening portion is hooked by a notch of double-mouth clamping elastic force in the sliding state, the two opening planes of the buckle slot are enlarged in the sliding state, wherein the distance between the ninth contact position and the tenth contact position of the buckle slot is longer than or equal to the distance between the third contact position and the fourth contact position of the fastening portion, the distance between the ninth contact position and the tenth contact position of the buckle slot is longer than or equal to the distance between the first contact position and the second contact position of the fastening portion, and the distance between the ninth contact position and the tenth contact position of the buckle slot is longer than or equal to the distance between the sixth contact position and the seventh contact position of the fastening portion, the distance between the ninth contact position and the tenth contact position of the buckle slot is longer than or equal to the distance between the fifth contact position and the eighth contact position of the fastening portion.

4. The combined device of a box as claimed in claim 3, wherein the fastening portion has a convex body on the first contact surface, the buckle slot has a positioning slot, the positioning slot is located at a corresponding hooked position to the convex body, the convex body is hooked and combined with the positioning slot to form the buckle slot and the fastening portion to be held, wherein the fastening portion is located on a clasp piece, and a position of the clasp piece is connected by a bending portion, the position of the clasp piece is selected from at least one of the opening edges of the lid and the shell body.

5. The combined device of a box as claimed in claim 3, wherein the fastening portion has a convex body located on the fourth contact surface, the buckle slot has a positioning slot, the positioning slot is located at a corresponding hooked position to the convex body, and the convex body is hooked and combined with the positioning slot to form the buckle slot and the fastening portion to be held, wherein the position of the buckle slot is selected from at least one of the opening edges of the lid and the shell body, wherein the buckle slot is further recess toward inside recessed position of the opening edge, and the position where the buckle slot is connected is selected from at least one of the opening edges of the lid and the shell body.

6. The combined device of a box as claimed in claim 3, wherein the opening slot surface structure of the buckle slot, the ninth contact position and the tenth contact position where an opening for hooking are selected at least one of a convex rectangle shape, a triangle shape, an arc shape, and a trapezoid shape, wherein the inner side of the accommodating cavity, the eleventh contact position, the twelfth contact position, the thirteenth contact position, the fourteenth contact position, the fifteenth contact position, and the sixteenth contact position are at least one of triangular shape, arc shape and trapezoid shape, wherein the connection structure between the first contact surface, the second contact surface, the third contact surface, and the fourth contact surface is selected from at least one of a triangular shape and an arc shape.

7. The combined device of a box as claimed in claim 1, wherein the soft and elastic material is composed of at least one material selected from paper plastic, plastic, and environmental protection resin.

* * * * *